US008033639B2

(12) United States Patent
Kato et al.

(10) Patent No.: US 8,033,639 B2
(45) Date of Patent: Oct. 11, 2011

(54) INKJET RECORDING APPARATUS, METHOD OF CLEANING A RECORDING HEAD, AND A COMPUTER READABLE MEDIUM ENCODING THE METHOD

(75) Inventors: Yoshinori Kato, Nagoya (JP); Nobuo Hiraki, Nagoya (JP); Tomohisa Higuchi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 384 days.

(21) Appl. No.: 12/196,870

(22) Filed: Aug. 22, 2008

(65) Prior Publication Data

US 2009/0051732 A1 Feb. 26, 2009

(30) Foreign Application Priority Data

Aug. 24, 2007 (JP) ..... 2007-217802

(51) Int. Cl.
*B41J 2/165* (2006.01)

(52) U.S. Cl. ..... 347/33; 347/22; 347/28; 347/30; 347/37

(58) Field of Classification Search ..... 347/22, 347/28, 30, 33, 37
See application file for complete search history.

(56) References Cited

U.S. PATENT DOCUMENTS 6,352,334 B2 * 3/2002 Fukushima et al. ..... 347/33

FOREIGN PATENT DOCUMENTS

JP 2006-192693 7/2006

* cited by examiner

*Primary Examiner* — Ryan Lepisto
*Assistant Examiner* — Guy Anderson
(74) *Attorney, Agent, or Firm* — Scully, Scott, Murphy & Presser, PC

(57) ABSTRACT

An inkjet recording apparatus, method and computer readable medium are provided. The inkjet recording apparatus includes a recording head comprising a nozzle formation surface having a plurality of ink discharging nozzles formed thereon; a wiper which has elasticity and wipes the nozzle formation surface by pressingly contacting against the nozzle formation surface of the recording head; and a moving unit which moves at least one of the recording head and the wiper to wipe the nozzle formation surface at a first relative speed and moves the at least one of the recording head and the wiper to separate from each other at a second relative speed, which is less than the first relative speed. The method includes moving at least one of the inkjet recording head and the wiper relative to each other so that the wiper wipes the nozzle formation surface at a first relative speed; and separating the wiper from the inkjet recording head at a second relative speed, which is less than the first relative speed.

10 Claims, 9 Drawing Sheets

INKJET RECORDING APPARATUS, METHOD OF CLEANING A RECORDING HEAD, AND A COMPUTER READABLE MEDIUM ENCODING THE METHOD

CROSS-REFERENCE TO RELATED APPLICATION

This application claims priority from Japanese Patent Application No. 2007-217802, filed on Aug. 24, 2007, the entire subject matter of which is incorporated herein by reference.

TECHNICAL FIELD

Apparatuses, methods, and computer readable mediums consistent with the present invention relate to an inkjet recording and, more particularly, to cleaning inkjet recording heads using a wiping mechanism.

BACKGROUND

A related art inkjet recording apparatus records an image on a recording medium. The recording medium is conveyed to a position opposing a nozzle formation surface having a plurality of ink discharging nozzles formed thereon, and ink is discharged from the nozzles onto the recording medium. This related art inkjet recording apparatus is provided with a wiper blade with elasticity that is pressingly contacted against the nozzle formation surface and wipes the nozzle formation surface.

For example, Japanese Published Unexamined Patent Application No. 2006-192693 describes a related art inkjet recording apparatus provided with the wiper blade. In the related art inkjet recording apparatus, a carriage 100 is stopped at an intermediate position of a wiping operation. A wiper blade 21, which is an elastic member, is in a flexed state and performs a remainder of the wiping operation of wiping to an end of the nozzle formation surface by moving the wiper blade 21 in a direction which decreases the flexing.

However, the related art inkjet recording apparatus has some disadvantages. For example, the wiper blade 21 is moved in the direction which decreases the flexing. The wiping process uses a complex mechanism that includes a wiper unit 20 to move the wiper blade 21.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an inkjet recording apparatus enabled, by a simple arrangement, to suppress splashing of ink inside the device when a flexing of the wiper blade decreases.

According to an exemplary embodiment of the present invention, there is provided an inkjet recording apparatus comprising a recording head comprising a nozzle formation surface having a plurality of ink discharging nozzles formed thereon; a wiper which has elasticity and wipes the nozzle formation surface by pressingly contacting against the nozzle formation surface of the recording head; and a moving unit which moves at least one of the recording head and the wiper to wipe the nozzle formation surface at a first relative speed and moves the at least one of the recording head and the wiper to separate from each other at a second relative speed, which is less than the first relative speed.

According to another exemplary embodiment of the present invention, there is provided a method of cleaning a nozzle formation surface of an inkjet recording head with a wiper, the method comprising moving at least one of the inkjet recording head and the wiper relative to each other so that the wiper wipes the nozzle formation surface at a first relative speed; and separating the wiper from the inkjet recording head at a second relative speed, which is less than the first relative speed.

According to yet another exemplary embodiment of the present invention, there is provided a computer readable medium encoded with a program for performing a method of cleaning a nozzle formation surface of an inkjet recording head with a wiper, the method comprising moving at least one of the inkjet recording head and the wiper relative to each other so that the wiper wipes the nozzle formation surface at a first relative speed; and separating the wiper from the inkjet recording head at a second relative speed, which is less than the first relative speed.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 3 shows sectional views of a wiping mechanism of the printer unit of FIG. 2, and in particular.

DETAILED DESCRIPTION

Figure 1:
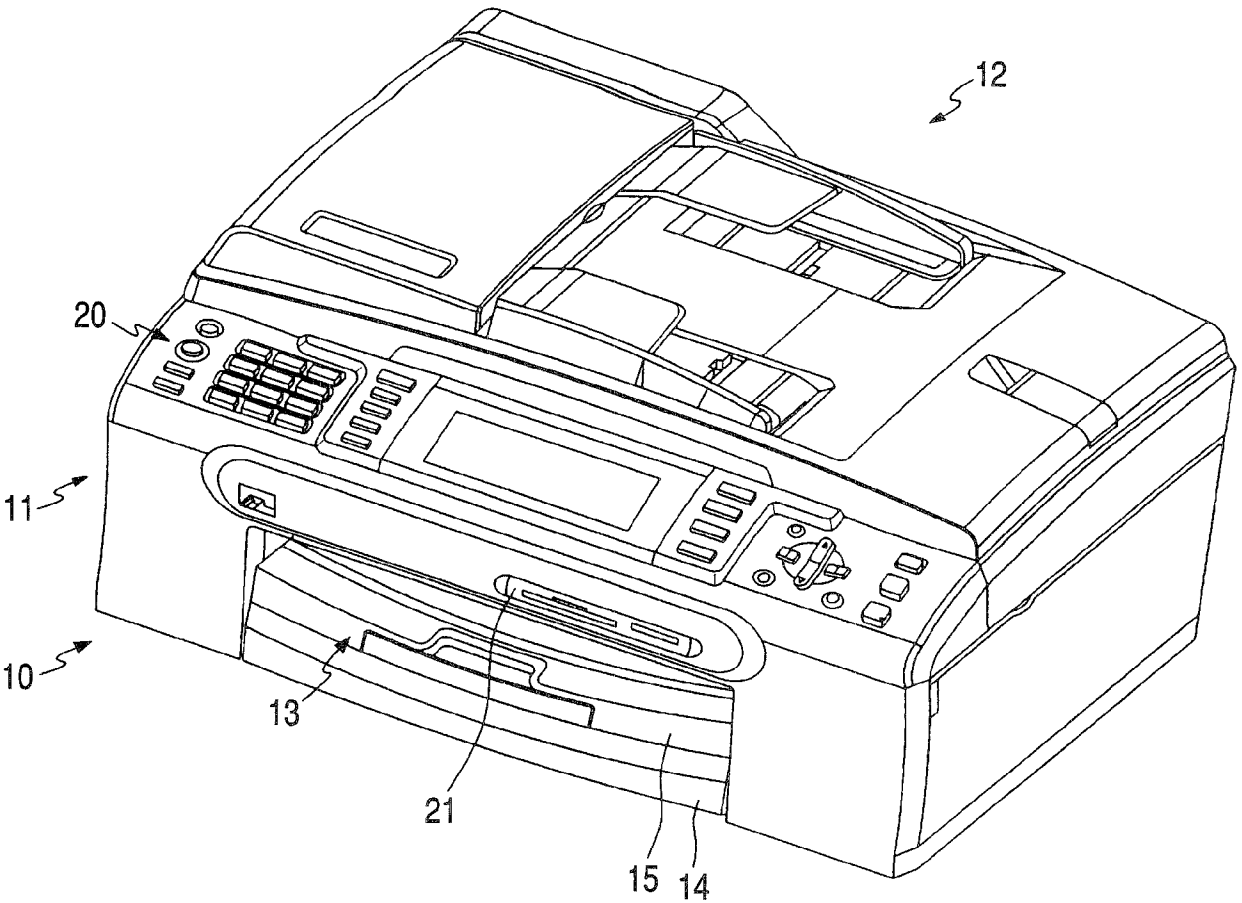
FIG. 1 is an external perspective view of a multi function device according to an exemplary embodiment of the present invention.

FIG. 1 is an external perspective view of a multi function device 10 according to an exemplary embodiment of the present invention. The multi function device (MFD) integrally includes a printer unit 11 at a lower portion and scanner unit 12 at an upper portion, and the MFD 10 has, for example, a printer function, scanner function, copy function, and facsimile function. Functions besides the printer function in the multi function device 10 are arbitrary and may be omitted. That is, the present invention may also be embodied in a single-function printer not having the scanner unit 12 and not having the scanner function or the copy function.

The multi function device 10 may be coupled to a personal computer (not shown). An image or document is printed onto a recording sheet, which is an example of a recording medium, based on printing data, including image data and document data, sent from the personal computer. However, the usage mode of the multi function device 10 is not restricted to the above mode, and the multi function device 10 may be coupled to any external equipment, such as a digital camera, and an image data output from the digital camera may be recorded on a recording sheet, and any of various types of storage media, such as a memory card, etc., may be installed in the multi function device 10 and image data, etc., stored in the storage media may be recorded on a recording sheet.

The printer unit 11 includes an opening 13 formed on a front surface, and a sheet feeding tray 14 and a sheet discharging tray 15 are disposed in two vertical stages in a manner such that portions thereof are exposed from the opening 13. The sheet feeding tray 14 stores recording sheets. A recording sheet contained in the sheet feeding tray 14 is fed to an interior of the printer unit 11 and, after an image is recorded thereon, is discharged to the sheet discharging tray 15.

An operation panel 20 is disposed at a front upper portion of the multi function device 10. The operation panel 20 includes various operation buttons and a liquid crystal display unit for operation of the printer unit 11 and the scanner unit 12. The multi function device 10 operates based on operation instructions from the operation panel 20. In a case where the multi function device 10 is coupled to the personal computer, the multi function device 10 may also operate based on instructions transmitted from the personal computer via a printer driver or a scanner driver. A slot portion 21 is disposed on the front surface of the multi function device 10. Any of various types of compact memory cards, which are examples of storage media, are enabled to be installed in the slot portion 21. Based on an input from the operation panel 20, image data, recorded in a compact memory card installed in the slot portion 21, are read, and information concerning the image data is displayed on the liquid crystal display unit or an image is recorded on a recording sheet by the printer unit 11.

Figure 2:
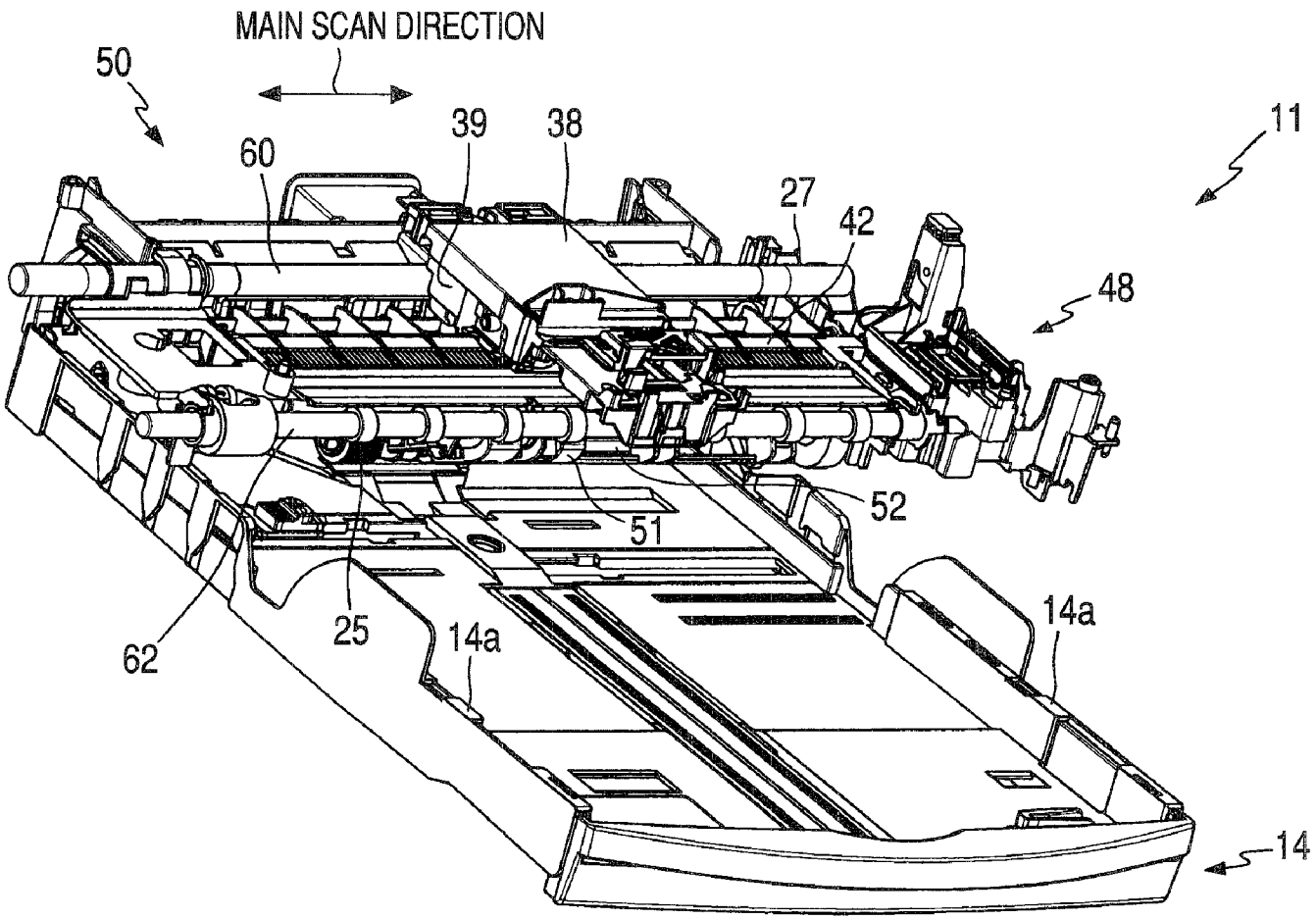
FIG. 2 is a perspective view of an arrangement of a printer unit of the multi function device of FIG. 1.

FIG. 2 is a perspective view of an arrangement of the printer unit 11. The printer unit 11 comprises the sheet feeding tray 14, a feed roller 25, disposed above the sheet feeding tray 14, a conveying guide member 50, erected from an inner side of the sheet feeding tray 14 and forming a conveying path for conveying a recording sheet fed from the feed roller 25, a recording head 39, disposed in a manner enabling reciprocal movement between a conveying roller 60 and a discharge roller 62 at a downstream side of the conveying guide member 50, a platen 42, disposed opposite an ink discharging surface of the recording head 39, and a maintenance unit 48, disposed at a position adjacent the platen 42 and within a scan range of a carriage 38.

The sheet feeding tray 14 is formed in a substantially box-like shape with an upper side being open, and recording sheets are stacked and housed in an interior of the sheet feeding tray 14. At side walls of the sheet feeding tray 14 are formed supports 14*a* that support the sheet discharging tray 15 (see FIG. 1), which is not shown in FIG. 2. The sheet discharging tray 15 is slidably supported on the supports 14*a*.

The feed roller 25 rotates in a state of contacting a recording sheet stacked on the sheet feeding tray 15, and feeds the recording sheet to the conveying roller 60 via a conveying path formed by the conveying guide member 50. The feed roller 25 is axially supported in a manner enabling rotation at one end of an arm 51. The arm 51 is supported in a manner enabling pendulum-like rotation with respect to a shaft 52. An angle formed by the arm 51 and the recording sheet is configured to vary according to an amount of recording sheets stacked on the sheet feeding tray 14. At an interior of the arm 51, a plurality of gears (not shown) are aligned along a straight line and the feed roller 25 is rotated via the gears.

The conveying guide member 50 forms the conveying path by which the recording sheet fed from the feed roller 25 is conveyed to the conveying roller 60. The conveying path is configured in a U-shaped manner. A driven roller (not shown) that rotates so as to follow the conveying roller 60 is disposed opposite the conveying roller 60, and the recording sheet conveyed via the conveying path is sandwiched by the conveying roller 60 and the driven roller and conveyed between the recording bead 39 and the platen 42.

The recording head 39 comprises, on a surface opposing the platen 42, a nozzle formation surface, on which nozzles that discharge ink are formed, and an image is formed by discharge of ink droplets from the nozzles onto the recording medium supported by the platen 42 and conveyed to a position opposing the nozzle formation surface. Inks of the various colors, for example of cyan (C), magenta (M), yellow (Y), and black (Bk), are supplied to the recording head 39 from ink cartridges (not shown), detachably installed in the multi function device 10.

The recording head 39 is mounted on the carriage 38 and is configured to be move so as to reciprocate in a main scan direction. The carriage 38 is configured to move in a reciprocating manner across a range of the platen 42 and the maintenance unit 48. Recording onto the recording medium is executed at a region opposite the platen 42, and maintenance of the recording head 39 is executed at a region opposite the maintenance unit 48.

The platen 42 is disposed opposite and below the recording head 39 and supports the recording sheet, conveyed from the conveying roller 60, from an opposite side with respect to the recording head 39. The recording head 39, to which the inks are supplied, discharges the inks as microscopic ink droplets toward the platen 42 side while moving back and forth and thereby forms an image on the recording sheet conveyed onto the platen 42.

A driven roller (not shown), rotating so as to follow the discharge roller 62, is disposed opposite the discharge roller 62. The discharge roller 62 is disposed so as to sandwich the platen 42 with the conveying roller 60, and the recorded recording sheet, conveyed from between the recording head 39 and the platen 42, is clamped by the feed roller 60 and the driven roller and discharged onto the sheet discharging tray 15 (see FIG. 1).

The maintenance unit 48 includes a wiping mechanism, a purge mechanism, and a waste ink tray, etc. The wiping mechanism executes a wiping process of wiping off ink from the nozzle formation surface of the recording head 39, with a wiper blade having elasticity. The purging mechanism executes a purging process of drawing in ink from the nozzles, formed on the nozzle formation surface, in a state of closely sealing the nozzle formation surface of the recording head 39. Maintenance, such as removal of bubbles and mixed-color ink inside the recording head 39, etc., is performed by the maintenance unit 48.

The maintenance unit 48 is provided with a carriage lever 27, and when the carriage 38 moves to a position opposite the maintenance unit 48, the carriage lever 27 is pushed down and a moving force of a line feed (LF) motor (see FIG. 5) becomes transmitted to the maintenance unit 48.

Figure 3A:
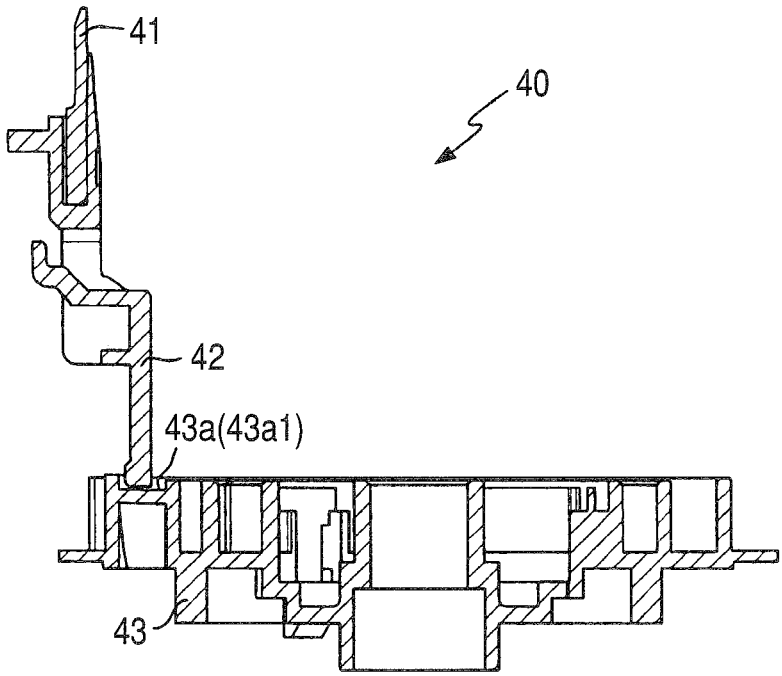
FIG. 3A is a sectional view of the wiper mechanism in a state in which a wiper blade contacts a nozzle formation surface.
Figure 3B:
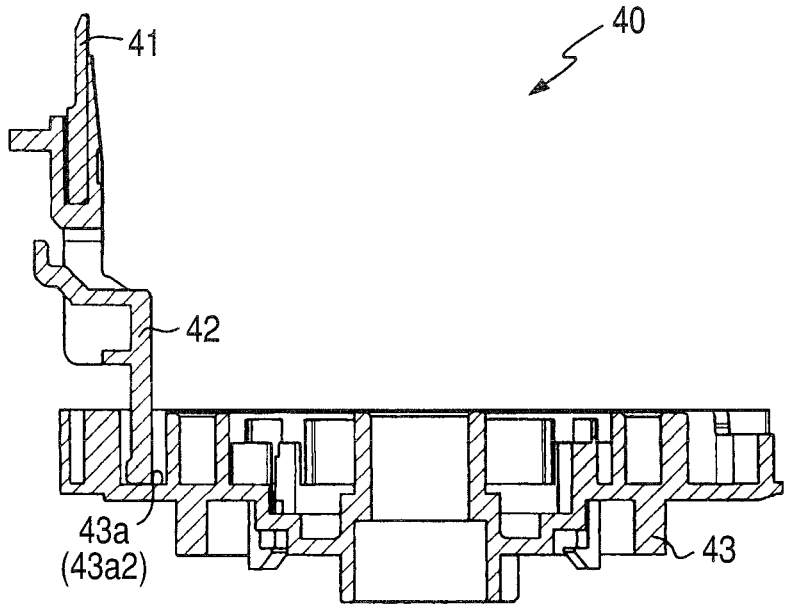
FIG. 3B is a sectional view of the wiper mechanism in a state in which the wiper blade is separated from the nozzle formation surface.

The wiping mechanism 40, included in the maintenance unit 48, shall now be described with reference to FIG. 3. FIG. 3 shows sectional views of the wiping mechanism 40, and in particular, FIG. 3A shows a state in which the wiper blade contacts the nozzle formation surface, and FIG. 3B shows a state in which the wiper blade is separated from the nozzle formation surface.

The wiping mechanism 40 is disposed as a portion of the maintenance unit 48, and is set at a position that opposes the recording head 39 when the recording head 39, mounted on the carriage 38, moves to the region opposing the maintenance unit 48.

As shown in FIG. 3, the wiping mechanism 40 includes the wiper blade 41 which has a plate-like shape with elasticity, a wiper holder 42, holding one end of the wiper blade 41, and a rotating member 43, holding the other end side of the wiper holder 42.

The wiper blade 41 and the wiper holder 42 are disposed so as to be able to retractably protrude from the rotating member 43 toward the nozzle formation surface of the recording head 39. The wiper blade 41 is, for example, a rubber blade with a length corresponding to a length in a conveying direction of a lower surface of the recording head 39. By being protruded from the rotating member 43 side, the wiper blade 41 is put in contact with the nozzle formation surface of the recording head 39 with a tip portion of the wiper blade 41 being put in a flexed state. The recording head 39 is slidingly moved along with the carriage 38 with the wiper blade 41 being in contact with the nozzle formation surface of the recording head 39. Ink attached to the nozzle formation surface is thereby wiped off by the wiper blade 41.

The wiper holder 42 is disposed so as to be able to retractably protrude toward the nozzle formation surface of the recording head 39 in accordance with a rotation of the rotating member 43 to be described later. By the wiper holder 42 protruding from the rotating member 43 toward the nozzle formation surface side, the wiper blade 41 supported by the wiper holder 42 is put in contact with the nozzle formation surface. By contrast, by the wiper holder 42 retracting toward the rotating member 43 side, the wiper blade 41 is separated from the nozzle formation surface.

The rotating member 43 makes the wiper holder 42 (along with the wiper blade 41) protrude and retract with respect to the nozzle formation surface of the recording head 39 and is rotatably disposed at a position at which the rotating member 43 sandwiches the wiper holder 42 and the wiper blade 41 with the nozzle formation surface of the recording head 39.

An annular cam groove 43*a* is formed in the rotating member 43. In the cam groove 43*a* are formed a first groove portion (43*a*1), in which a groove depth is a first depth across a certain range, and a second groove portion (43*a*2), in which the groove depth is a second depth that is deeper than the first depth and which is formed so as to be continuous with both ends of the first groove portion (43*a*1).

Thus, when the wiper holder 42 is positioned on the first groove portion (43*a*1), the wiper holder 42 protrudes from the rotating member 43 toward the nozzle formation surface side and the wiper blade 41 contacts the nozzle formation surface. Alternatively, when the wiper holder 42 is positioned on the second groove portion (43*a*2), the wiper holder 42 retracts into the rotating member 43 side and the wiper blade 41 separates from the nozzle formation surface. The wiper holder 42 is urged into the rotating member 43 by a coil spring (not shown) and thereby configured to protrude and retract readily in accordance with the cam groove 43*a*.

Figure 4:
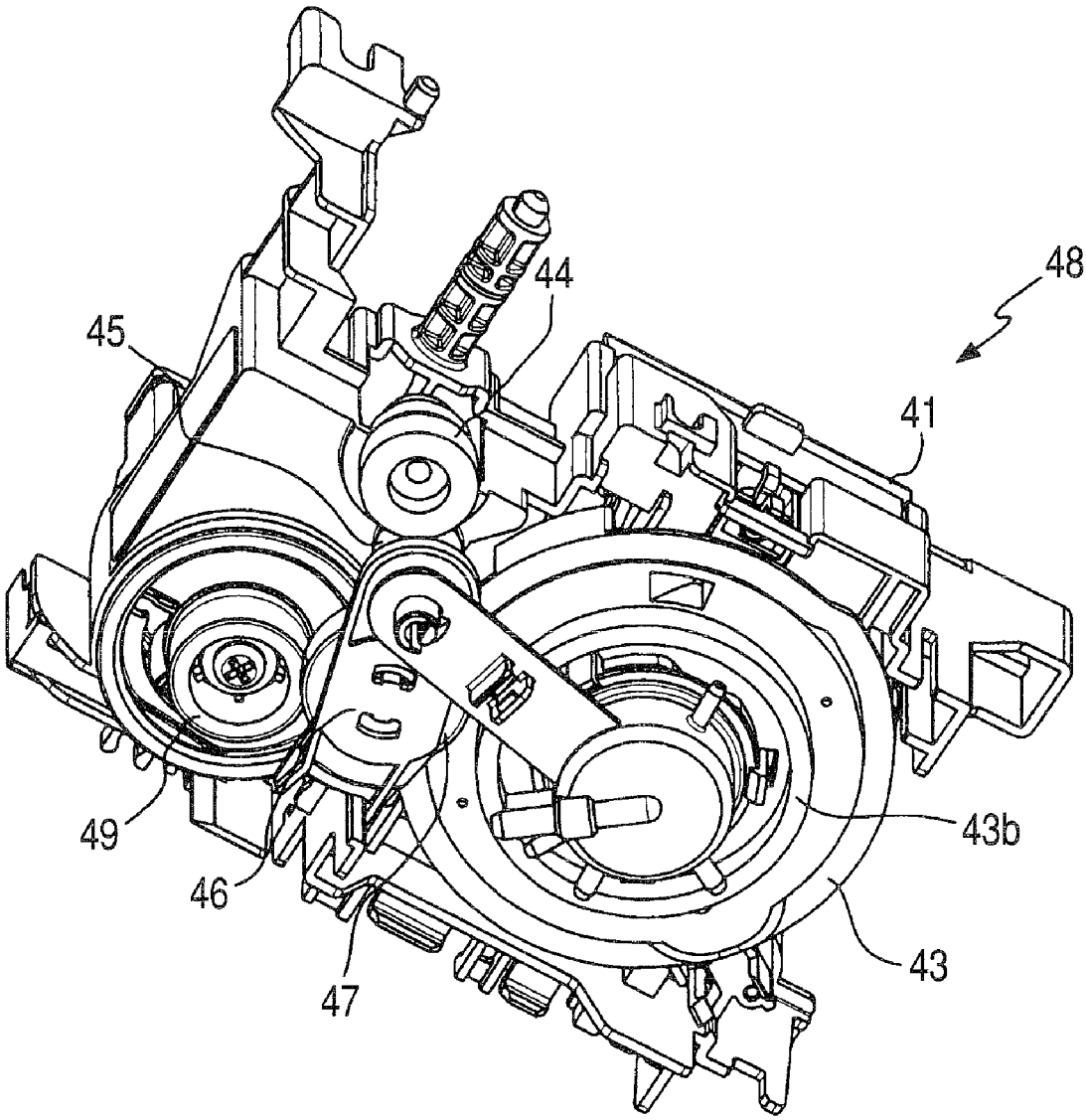
FIG. 4 is a perspective view of a rotating member of the wiper mechanism of FIGS. 3A and 3B as viewed from a bottom surface side.

A power transmission mechanism that rotates the rotating member 43 shall now be described with reference to FIG. 4. FIG. 4 is a perspective view of the rotating member 43 as viewed from a bottom surface side. As shown in FIG. 4, the power transmission mechanism that rotates the rotating member 43 includes a first gear 44, a second gear 45, engaging with the first gear 44, a link bar 46, having one end coupled to the second gear 45, and a third gear 47, coupled to the other end of the link bar 46.

In a state in which the carriage 38 has moved to a position opposing the maintenance unit 48 and the carriage lever 27 is pushed down, the LF motor 71 (see FIG. 5) is driven. The LF motor serves as a power source. A rotating force of the LF motor 71 is transmitted via a gear mechanism (not shown) to the first gear 44. For example, the first gear 44 rotates counterclockwise, as shown in FIG. 4. The second gear 45 and the link bar 46 then rotate clockwise in FIG. 4, and the third gear 47 engages with a fourth gear 49 for driving a pump to be used to execute the purging process.

When the LF motor 71 is rotated in a reverse direction, the first gear 44 rotates clockwise in FIG. 4. The second gear 45 and the link bar 46 then rotate counterclockwise, the third gear 47 engages with a fifth gear 43*b*, formed on the bottom surface of the rotating member 43, and the rotating member 43 is thereby driven to rotate. When the rotating member 43 is driven to rotate, the wiper holder 42 (along with the wiper blade 41) follows the cam groove 43*a*, formed in the rotating member 43, and protrudes and retracts with respect to the nozzle formation surface of the recording head 39.

Figure 5:
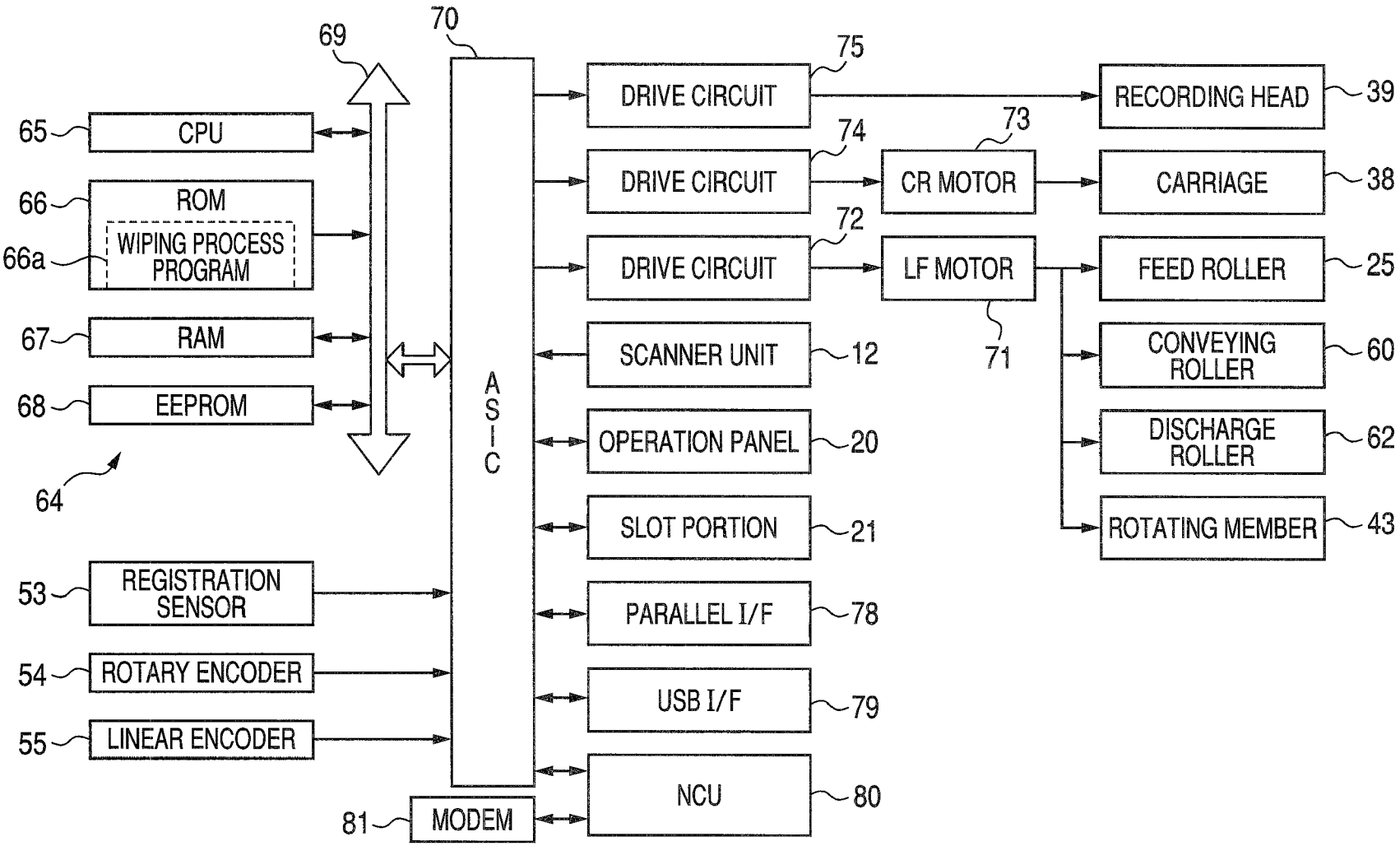
FIG. 5 is a block diagram of an arrangement of a controller of the multi function device of FIG. 1.

FIG. 5 is a block diagram of an arrangement of a controller 64 of the multi function device 10. The controller 64 may control components of the multi function device in addition to the printer unit 11, for example the controller 64 may control the scanner unit 12. However, a detailed description of these other components will be omitted. As shown in the figure, the controller 64 is configured as a microcomputer comprising a central processing unit (CPU) 65, a read only memory (ROM) 66, a random access memory (RAM) 67, and an electrically erasable and programmable ROM (EEPROM) 68, and is coupled to an application specific integrated circuit (ASIC) 70 via a bus 69.

In the ROM 66 is stored a program for controlling various operations of the multi function device 10. For example, a wiping process program 66*a*, shown in FIG. 6, for executing the wiping process is stored. The RAM 67 is used as a working area or a storage area in which the CPU 65 temporarily records various data to be used in executing the abovementioned programs. Settings, flags, etc., to be held even after turning off the power to the multi function device, are stored in the EEPROM 68.

In accordance with a command from the CPU 65, the ASIC 70 generates a phase excitation signal, etc., to be supplied to the LF motor 71, provides the signal to a drive circuit 72 of the LF motor 71, and by thus supplying the drive signal to the LF motor 71 via the drive circuit 72, performs rotation control of the LF motor 71.

The drive circuit 72 drives the LF motor 71, which is coupled to the feed roller 25, the conveying roller 60, the discharge roller 62, and the rotating member 43, etc. Upon receiving the signal output from the ASIC 70, the drive circuit 72 forms an electrical signal for rotating the LF motor 71. Upon receiving the electrical signal, the LF motor 71 rotates, and the rotational force of the LF motor 71 is transmitted via a driving mechanism, comprising a gear, a drive shaft, etc., to the feed roller 25, the conveying roller 60, the discharge roller 62, and the rotating member 43.

In accordance with a command from the CPU 65, the ASIC 70 generates a phase excitation signal, etc., to be supplied to a carriage (CR) motor 73, provides the signal to a drive circuit 74 of the CR motor 73, and by thus supplying the drive signal to the CR motor 73 via the drive circuit 74, performs rotation control of the CR motor 73.

The drive circuit 74 drives the CR motor 73, which is coupled to the carriage 38. Upon receiving the signal output from the ASIC 70, the drive circuit 74 forms an electrical signal for rotating the CR motor 73. Upon receiving the electrical signal, the CR motor 73 rotates and, by the rotational force of the CR motor 73 being transmitted to the carriage 38, the carriage 38 is moved back and forth.

A drive circuit 75 makes the recording head 39 discharge ink selectively at certain timings onto the recording sheet. The drive circuit 75 drives and controls the recording head 39 upon receiving an output signal generated at the ASIC 70 based on a drive control procedure output from the CPU 65.

To the ASIC 70 are coupled the scanner unit 12, the operation panel 20 for making operation instructions to the multi function device 10, the slot portion 21, into which various types of compact memory cards may be inserted, a parallel interface 78 and a universal serial bus (USB) interface 79 for sending and receiving data to and from the personal computer and other external equipment via a parallel cable and/or a USB cable. A network control unit (NCU) 80 and a modem 81 are also coupled to the ASIC 70 for realizing a facsimile function.

In addition to the above, a registration sensor 53, which detects the conveying of the recording medium from the feed roller 25 to the conveying roller 60, a rotary encoder 54, which detects a rotation amount of the conveying roller 60, and a linear encoder 55, which detects a moving amount of the carriage 38, are also coupled to the ASIC 70.

Figure 6:
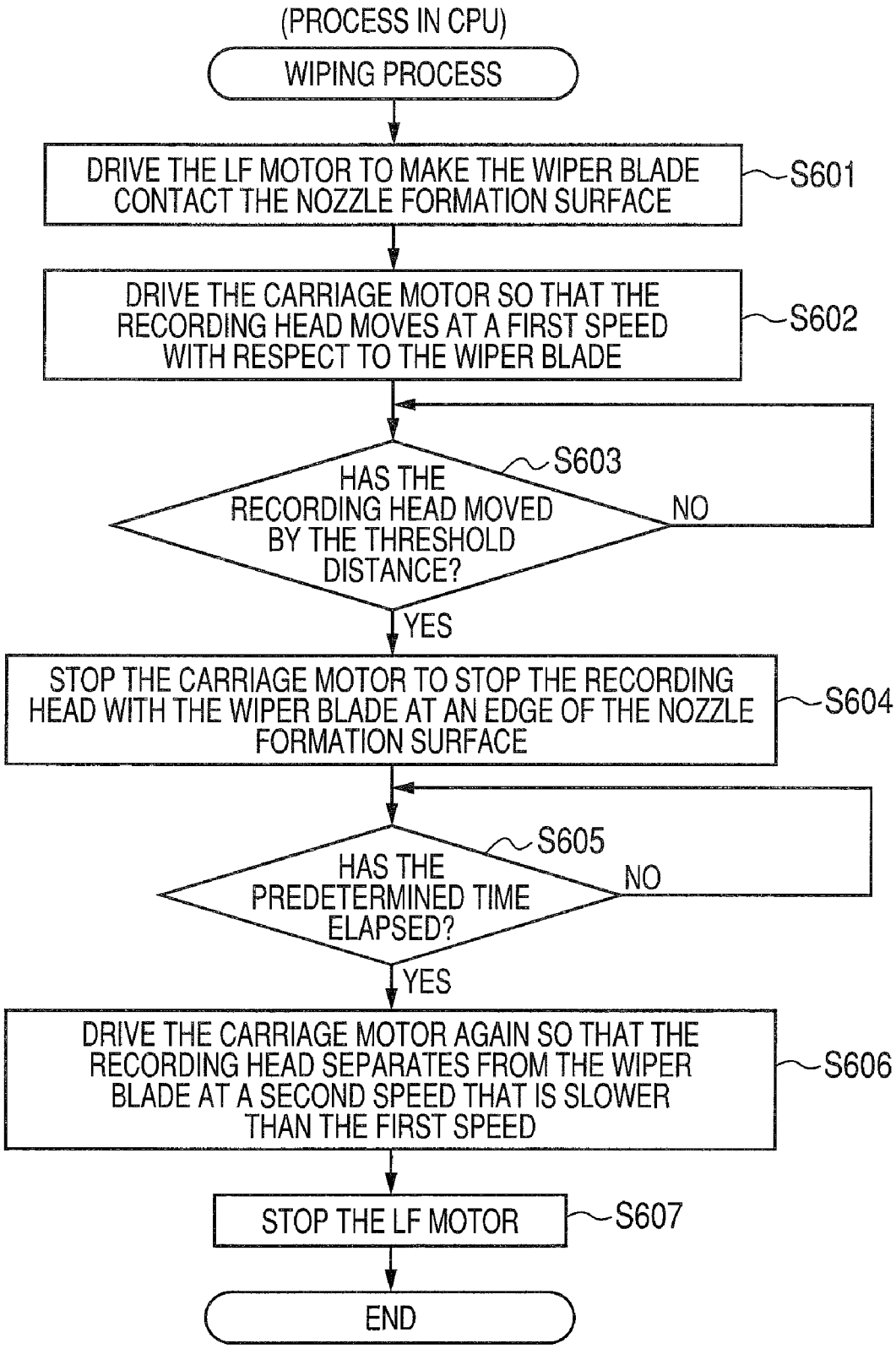
FIG. 6 is a flowchart of a wiping process used in the multi function device of FIG. 1.
Figure 7A:
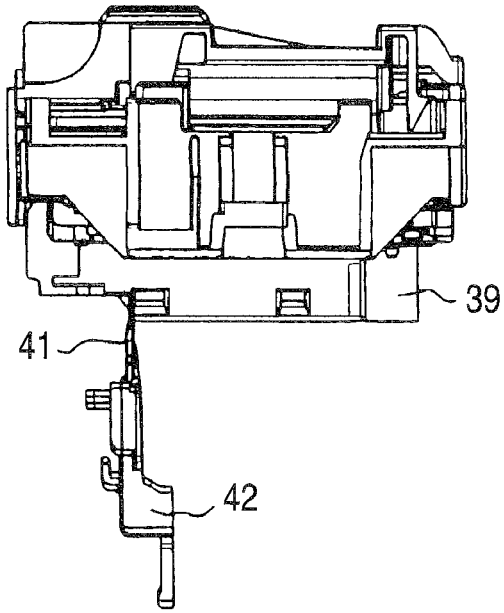
FIGS. 7A to 7D are diagrams of relationships of a recording head and the wiper blade in an order of a time series in the wiping process of FIG. 6.
Figure 7B:
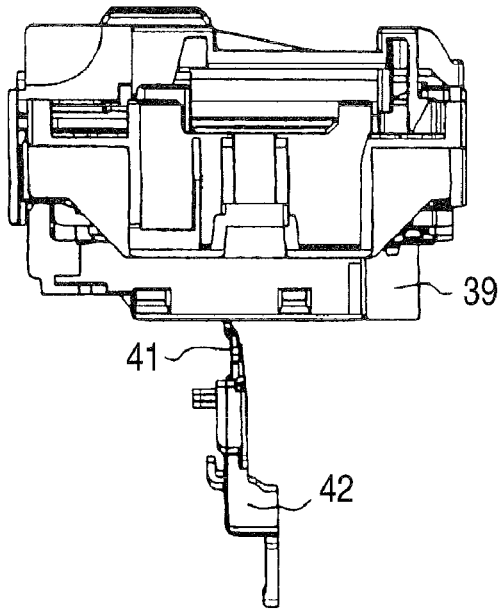
Figure 7C:
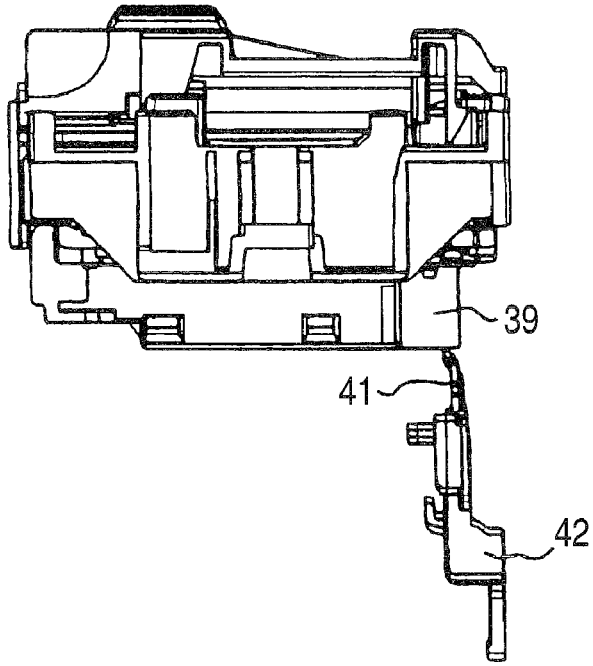
Figure 7D:
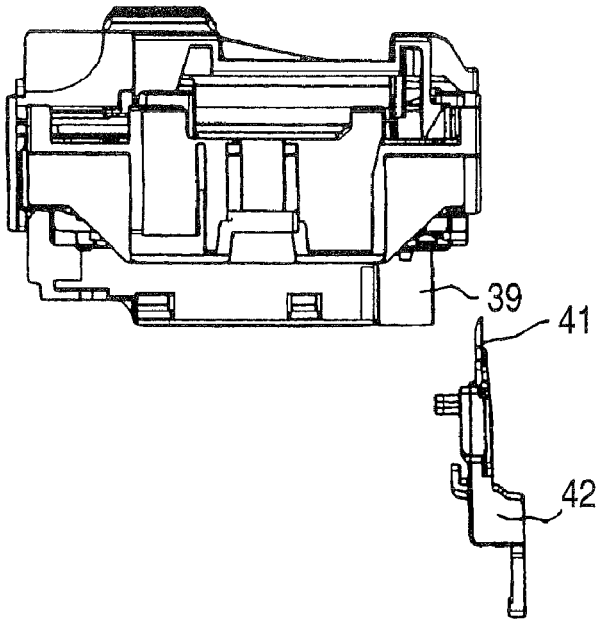
Figure 8:
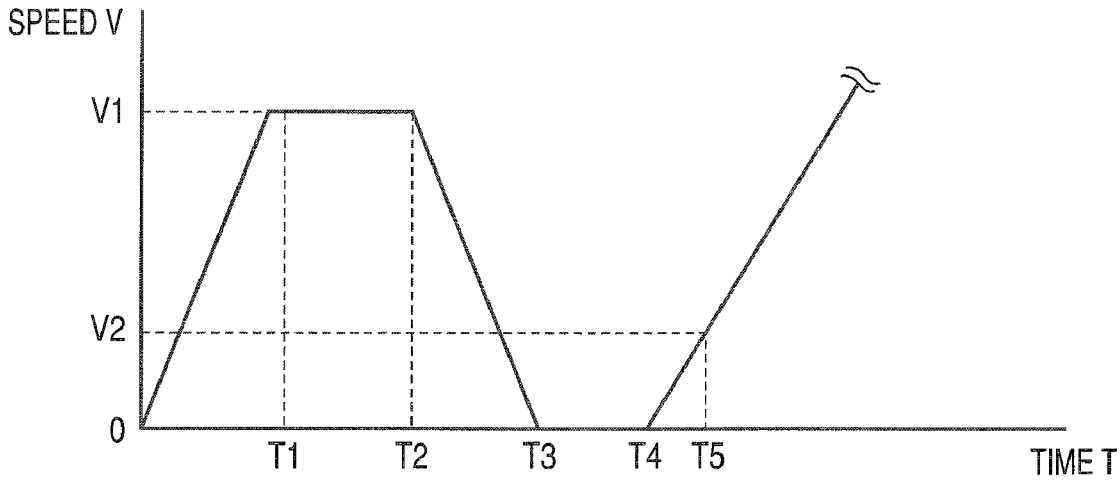
FIG. 8 is a graph of a relationship between a relative speed V of the wiper blade of FIGS. 7A to 7D with respect to the recording head and a time T in the wiping process.

An operation of the wiping mechanism 40 with the above-described arrangement shall now be described with reference to FIGS. 6 and 7A to 7D. FIG. 6 is a flowchart of the wiping process. FIGS. 7A to 7D are diagrams of relationships of the recording head 39 and the wiper blade 41 in an order of a time series in the wiping process. FIG. 8 is a graph of a relationship between a relative speed V of the wiper blade 41 with respect to the recording head 39 and a time T in the wiping process. In FIGS. 7A and 7B, states in which the wiper blade 41 is moved relative to the recording head 39 that is stopped are shown.

The wiping process may be executed after the purging process or after the recording operation. The recording head 39 is moved to a wiping process execution starting position.

As shown in FIG. 6, in the wiping process, the LF motor 71 is driven so that the wiper blade 41 contacts the nozzle formation surface of the recording head 39 (S601). That is, the rotating member 43 is rotated by the LF motor 71 so that the wiper holder 42 is positioned on the first groove portion 43*a*1 of the cam groove 43*a*. When the wiper blade 41 contacts the nozzle formation surface of the recording head 39, the carriage motor 73 is driven so that the recording head 39 moves at a first speed (V1) with respect to the wiper blade 41 (S602).

The process up to this point shall now be described with reference to FIGS. 7A, 7B, and 8. FIG. 7A shows a state in which the wiper blade 41 contacts the nozzle formation surface of the recording head 39. The relative speed V of the wiper blade 41 and the time T at this point are deemed to be 0 (see FIG. 8).

After the state shown in FIG. 7A is entered, the carriage motor 73 is driven so that the relative speed of the wiper blade 41 becomes the relative speed V1 (first speed) and the wiper blade 41 is thereby moved relative to the recording head 39. FIG. 7B shows a state where the wiper blade 41 is moving at the relative speed V1 at a time T1. In this state, because the wiper blade 41 moves relative to the recording head 39 while contacting the nozzle formation surface, ink attached to the nozzle formation surface is wiped by the wiper blade 41.

The description shall now be continued by returning to FIG. 6. Upon driving of the carriage motor 73 at S602, it is determined whether the recording head 39 has moved a threshold distance (S603). The threshold distance may be predetermined. The movement distance of the recording head 73 is detected by the linear encoder 55. If the recording head 39 has not moved by the threshold distance (S603: No), the process of S603 is repeated until the recording head 39 has moved by the threshold distance.

On the other hand, if it is determined that the recording head 39 has moved the threshold distance (S603: Yes), the carriage motor 73 is stopped in order to stop the recording head 39 (S604), and it is determined whether a threshold time has elapsed thereafter (S605). The threshold time may be predetermined. If the threshold time has not elapsed (S605: No), the process of S605 is repeated until the threshold time elapses.

The process up to this point shall now be described with reference to FIGS. 7B, 7C, and 8. When, as shown in FIG. 7B, the wiper blade 41 has moved relative to the recording head 39 at the relative speed V1 by just the threshold distance, the carriage motor 73 is stopped. When the carriage motor 73 is stopped, the relative speed of the wiper blade 41 decelerates from the relative speed V1 (first speed) from a time T2 and becomes 0 at a time T3, and the wiper blade 41 is stopped with respect to the recording head 39 just at the edge of the nozzle formation surface until the time becomes T4 as shown in FIG. 8. FIG. 7C shows a state in which the wiper blade 41 is stopped with respect to the recording head 39 at the edge of the nozzle formation surface from the time T3 to the time T4. The stopping of the carriage motor 73 is controlled so that, as shown in FIG. 7C, the wiper blade 41 stops immediately before separating from the nozzle formation surface of the recording head 39.

By thus making the wiper blade 41 stop for a threshold time just at the edge of the nozzle formation surface, the ink that has been wiped by the wiper blade 41 and has become attached to the wiper blade 41 up to this point is allowed to flow down along the wiper blade 41 to thereby enable an amount of ink retained between the wiper blade 41 and the nozzle formation surface to be reduced. Also, by making the wiper blade 41 stop at the edge of the nozzle formation surface immediately before separating from the nozzle formation surface of the recording head 39, the amount of ink retained between the nozzle formation surface and an end of the wiper blade is reduced more than in a case in which the wiper blade is stopped earlier than the position immediately before separation.

The description shall now be continued by returning to FIG. 6. When it is determined that the threshold time has elapsed upon stoppage of the carriage motor 73 (S605: Yes), the carriage motor 73 is driven again so that the recording head 39 separates from the wiper blade 41 at a second speed slower than the first speed (S606). After elapse of a threshold time, the LF motor 71 is stopped (S607) and the process is ended.

The process up to this point shall now be described with reference to FIGS. 7C, 7D, and 8. When, in the state in which the wiper blade 41 is stopped with respect to the recording head 39 at the time T4 as shown in FIG. 7C, the carriage motor 73 is driven again, the wiper blade 41 begins relative movement again at a threshold acceleration as shown in FIG. 7B. The threshold acceleration may be predetermined. At a time T5, the wiper blade 41 separates from the nozzle formation surface at a relative speed V2 (second speed).

The wiper blade 41 is thus be controlled to change from a flexed state to a non-flexed state more slowly. Also, because simply the speed needs to be controlled, a complex mechanism is not used. Splashing of ink inside the device due to a momentum of the wiper blade 41 during the process of unflexing, i.e., the process of moving from a flexed state to a non-flexed state, can thus be suppressed by a simple arrangement. Also, because the wiper blade 41 separates from the nozzle formation surface during acceleration, the wiping process can be executed in a short time.

Additional Exemplary Embodiments

It should be noted that although a case in which the recording head 39 is stopped before the wiper blade 41 separates from the nozzle formation surface was described, as long as the second speed of the recording head 39 is slower than the first speed at which the wiper blade 41 wipes the nozzle formation surface, the recording head 39 does not have to be stopped once and the wiper blade 41 can be made to separate from the nozzle formation surface at a speed, during deceleration from the first speed, that is slower than the first speed. In other words, the wiper blade 41 may be removed from the nozzle formation surface during deceleration from the first speed but before completely stopping. In this case, the wiper blade 41 can still be made to become unflexed slowly and the splashing of ink inside the device during unflexing of the wiper blade 41 can be suppressed in the same manner as described above. Moreover, by not stopping the recording head 39, the wiping process can be executed in a short time and motor control of the carriage motor 73 can be simplified. Obviously, the wiper blade 41 can be made to separate from the nozzle formation surface in a state where the speed is fixed at the second speed upon deceleration from the first speed without stopping the recording head 39.

Additionally, a case in which the recording head 39 is moved with respect to the wiper blade 41 was described. However, alternatively, the wiper blade 41 may be configured to move with respect to the recording head 39 without moving the recording head 39 or to move both the recording head 39 and the wiper blade 41 at the same time relative to each other to execute the wiping process at the above-described speed relationships of the recording head 39 and the wiper blade 41.

Moreover, by arranging the depth of the cam groove 43*a* of the rotating member 43 so as to become gradually deeper at a portion corresponding to the time T4 to the time T5 shown in FIG. 8, the wiper blade 41 can be made to move in a direction of separating gradually from the nozzle formation surface to thereby enable the wiper blade 41 to become unflexed gradually and thus further suppress the splashing of ink inside the device in the process of unflexing of the wiper blade 41.

On the nozzle formation surface of the recording head 39 shown in FIGS. 7A to 7D, an unflexing restricting portion that contacts the wiper blade 41 may be formed at an end in a direction of relative movement of the wiper blade 41 in the state of contacting the nozzle formation surface to make the wiper blade 41 become unflexed gradually. The unflexing restricting portion may be configured, for example, as a curving portion, curved in a direction of separating from the wiper blade 41, or an inclining portion, inclining in a direction of gradually separating from the wiper blade 41. By forming such an unflexing restricting portion, the wiper blade 41 can be made to move in the direction of separating gradually from the nozzle formation surface to enable the wiper blade 41 to become unflexed gradually and thereby enable further suppression of the splashing of ink inside the device in the process of unflexing of the wiper blade 41.

Accordingly, according to a first aspect of the present invention, there is provided an inkjet recording apparatus comprising a recording head including a nozzle formation surface having a plurality of ink discharging nozzles which are formed on the nozzle formation surface and discharge ink therefrom to record an image on a recording medium conveyed to a position opposing the nozzle formation surface; a wiper blade which has elasticity and wipes the nozzle formation surface by pressingly contacting against the nozzle formation surface of the recording head; and a moving unit which moves at least one of the recording head and the wiper blade to wipe the nozzle formation surface by the wiper blade with a first relative speed therebetween and thereafter moves the at least one of the recording head and the wiper blade to separate from each other with a second relative speed therebetween slower than the first relative speed.

According to a second aspect of the present invention, after moving the at least one of the recording head and the wiper blade with the first relative speed, the moving unit may stop the at least one of the recording head and the wiper blade for a threshold time before moving the at least one of the recording head and the wiper blade with the second relative speed.

According to a third aspect of the present invention, after the moving unit stops the at least one of the recording head and the wiper blade for the threshold time, the moving unit may move the at least one of the recording head and the wiper blade so as to separate from each other while accelerating the at least one of the recording head and the wiper blade at a certain acceleration.

According to a fourth aspect of the present invention, the stopping of the at least one of the recording head and the wiper blade may be executed after the nozzles have been wiped by the wiper blade at a position immediately before separation from the nozzle formation surface.

With the inkjet recording apparatus according to the first aspect, the recording head and the wiper blade are moved with respect to each other at the first speed to wipe the nozzle formation surface with the wiper blade and thereafter, the wiper blade is moved to separate from the nozzle formation surface at the second speed slower than the first speed. The wiper blade can thus be made to move from the flexed state to the non-flexed state more slowly than when the wiper blade is moved to separate from the nozzle formation surface a same speed as the wiping speed. Also, because the speed is controlled, a complex mechanism is not used. Thus, suppression of splashing ink inside the device by a simple configuration is thus provided.

With the inkjet recording apparatus according to the second aspect, in addition, because after moving the recording head relative to the wiper blade at the first speed, the relative movement is stopped for the threshold time before moving the recording head and the wiper blade relative to each other at the second speed, the ink that is wiped off along the wiper blade can be made to flow downward while the relative movement is stopped for the threshold time. An amount of ink retained between the wiper blade and the nozzle formation surface is reduced, such that further suppression of splashing of ink inside the device during unflexing of the wiper blade is thus provided.

With the inkjet recording apparatus according to the third aspect, in addition, because after stopping movement of the recording head and the wiper blade with respect to each other for the threshold time, the recording head and the wiper blade are again moved relative to each other so as to separate the wiper blade from the nozzle formation surface while movement of the recording head and the wiper blade relative to each other is accelerated at the certain acceleration, the wiping process of wiping the nozzle formation surface with the wiper blade may be executed in a short time.

With the inkjet recording apparatus according to the fourth aspect, in addition, because the stopping of the relative movement of the recording head and the wiper blade is executed after the nozzles have been wiped by the wiper blade at a position immediately before separation from the nozzle formation surface, the amount of ink retained between the nozzle formation surface and an end of the wiper blade can be reduced more than in a case in which the relative movement is stopped earlier. Thus, the amount of ink retained between the wiper blade and the nozzle formation surface is reduced such that the splashing of ink inside the device during unflexing of the wiper blade is further suppressed.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An inkjet recording apparatus comprising:

a recording head comprising a nozzle formation surface having a plurality of ink discharging nozzles formed thereon;

a wiper which has elasticity and wipes the nozzle formation surface by pressingly contacting against the nozzle formation surface of the recording head; and a moving unit configured to move at least one of the recording head and the wiper to wipe the nozzle formation surface at a first relative speed and move the at least one of the recording head and the wiper to separate from each other at a second relative speed, which is less than the first relative speed.

2. The inkjet recording apparatus according to claim 1, wherein the moving unit being configured to stop the at least one of the recording head and the wiper for a threshold amount of time after the at least one of the recording head and the wiper is moved at the first relative speed, and before the at least one of the recording head and the wiper is moved at the second relative speed.

3. The inkjet recording apparatus according to claim 2, wherein the moving unit is configured to stop the at least one of the recording head and the wiper at a position in which the wiper is located at the edge of the nozzle formation surface.

4. The inkjet recording apparatus according to claim 2, wherein the moving unit is configured to move the at least one of the recording head and the wiper so as to separate from each other while accelerating the at least one of the recording head and the wiper at a certain acceleration after the moving unit stops the at least one of the recording head and the wiper for the threshold time.

5. The inkjet recording apparatus according to claim 2, wherein the moving unit is configured to stop the at least one of the recording head and the wiper after the plurality of ink discharging nozzles have been wiped by the wiper at a position immediately before separation from the nozzle formation surface.

6. The inkjet recording apparatus according to claim 1, wherein the at least one of the recording head and the wiper separate from each other during deceleration from the first relative speed to the second relative speed.

7. The inkjet recording apparatus according to claim 1, wherein the wiper gradually unflexes during the separation of the recording head and the wiper from each other.

8. The inkjet recording apparatus according to claim 7, wherein an unflexing restricting portion on the nozzle formation surface is configured to gradually unflex the wiper during the separation of the recording head and the wiper from each other.

9. The inkjet recording apparatus according to claim 1, wherein the moving unit is configured to move the at least one of the recording head and the wiper such that the wiper is moved in a straight direction with respect to the recording head.

10. The inkjet recording apparatus according to claim 1, wherein the moving unit is configured to move the at least one of the recording head and the wiper such that the wiper is moved at the first relative speed while the wiper opposes a predetermined area of the nozzle formation surface, the predetermined area including the plurality of ink discharging nozzles.

* * * * *